US011307004B2

(12) United States Patent
Hagberg et al.

(10) Patent No.: US 11,307,004 B2
(45) Date of Patent: Apr. 19, 2022

(54) TAIL PORTION FOR FIN-STABILIZED PROJECTILE

(71) Applicant: BAE SYSTEMS BOFORS AB, Karlskoga (SE)

(72) Inventors: Anders Hagberg, Karlskoga (SE); Tommy Ström, Degerfors (SE); Jan Axinger, Storfors (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 16/762,200

(22) PCT Filed: Sep. 26, 2018

(86) PCT No.: PCT/SE2018/050976
§ 371 (c)(1),
(2) Date: May 7, 2020

(87) PCT Pub. No.: WO2019/093939
PCT Pub. Date: May 16, 2019

(65) Prior Publication Data

US 2020/0355477 A1 Nov. 12, 2020

(30) Foreign Application Priority Data

Nov. 10, 2017 (SE) ..... 1700277-5

(51) Int. Cl.
*F42B 10/16* (2006.01)

(52) U.S. Cl.
CPC ..... *F42B 10/16* (2013.01)

(58) Field of Classification Search
CPC ..... F42B 10/16; F42B 10/26; F42B 10/14
See application file for complete search history.

(56) References Cited

U.S. PATENT DOCUMENTS

| | | | | |
|---|---|---|---|---|
| 2,784,669 | A * | 3/1957 | Apotheloz | F42B 10/16 244/3.29 |
| 2,923,241 | A * | 2/1960 | House | F42B 10/14 244/3.29 |
| 3,964,696 | A * | 6/1976 | Orzechowski | F42B 10/16 244/3.23 |
| 4,203,569 | A * | 5/1980 | Marks | F02K 9/978 244/3.23 |
| 6,044,765 | A | 4/2000 | Regebro | |
| 6,978,967 | B1 * | 12/2005 | Scheper | F42B 10/16 102/385 |

(Continued)

FOREIGN PATENT DOCUMENTS

| | | |
|---|---|---|
| DE | 750640 C | 1/1945 |
| EP | 0327680 A1 | 8/1989 |

(Continued)

OTHER PUBLICATIONS

International Search Report (dated Mar. 14, 2019) for corresponding International App. PCT/SE2018/050976.

*Primary Examiner* — Assres H Woldemaryam
(74) *Attorney, Agent, or Firm* — WRB-IP LLP

(57) ABSTRACT

A tail portion for a fin-stabilized projectile includes at least two deployable fins, which are inclined. The fins are arranged in at least two sections, which are arranged adjacent to another in the axial direction.

13 Claims, 4 Drawing Sheets

(56) References Cited

U.S. PATENT DOCUMENTS

| | | | | |
|---|---|---|---|---|
| 2003/0164110 | A1* | 9/2003 | Ronn | F42B 12/60 102/489 |
| 2005/0229806 | A1 | 10/2005 | Johnsson | |
| 2014/0131509 | A1* | 5/2014 | Stromberg | F42B 10/16 244/3.27 |
| 2016/0216086 | A1 | 7/2016 | Rastegar | |

FOREIGN PATENT DOCUMENTS

| | | | | |
|---|---|---|---|---|
| EP | 0802389 | A1 | 10/1997 | |
| EP | 1297297 | B1 | 2/2006 | |
| GB | 1288732 | * | 1/1970 | F42B 9/12 |
| GB | 1288732 | A | 9/1972 | |
| GB | 2060143 | A | 4/1981 | |
| WO | 2015128861 | A1 | 9/2015 | |

* cited by examiner

TAIL PORTION FOR FIN-STABILIZED PROJECTILE

BACKGROUND AND SUMMARY

The present invention relates to a tail portion for a fin-stabilized projectile, comprising at least two deployable fins, which are inclined.

Amongst the many types of projectiles which are used in various military connections are found fin-stabilized projectiles as an important sub-group of projectiles. Fin stabilization is used, for example, for shells which are fired with smooth-bore barrels. Fin stabilization provides a stability in the projectile trajectory, and the stability increases somewhat if the projectile, moreover, is made to rotate about its longitudinal axis, for example by tilting of the fins. In certain applications, it is sufficient if only a part of the projectile, for example a rear portion comprising the fins, rotates, whilst the rest of the projectile does not rotate at all, or only rotates at a lower frequency. A rotation can also compensate for an uneven outer symmetry or an uneven weight distribution in the projectile. The rotation increases in relation to the degree of tilting of the fins.

The rotation which provides a stabilization of the projectile trajectory can also be utilized to enable the projectile to make an effective scanning of the environment with the aid of, for example, proximity fuses, as are described in SE508652. The rotation means that the proximity fuse scans the environment along a helical path which is defined partly by the projectile trajectory and partly by the rotation of the projectile, which has been superimposed on the projectile trajectory.

SE508652 does not give any details of how the rotation is generated. By contrast, there are a host of documents regarding how fins are arrangeable in the tail portion of a projectile.

The fins are generally arranged in a ring around the circumference of the projectile in its rear portion. They are either curved or flat in their deployed position. A typical example of symmetrically arranged, flat fins is shown in SE521445.

The characteristics of the fins and their effect on the projectile are determined to a large extent by their combined area. This area is limited, however, by the fact that it must be possible to arrange the fins in a stowed position during the firing, after which they assume their deployed position. The combined fin area is normally not greater than the circumference of the tail portion multiplied by the extent of the fins in the longitudinal direction, insofar as the fins are not mutually overlapped. Overlapping fins demand specific design measures, however, in order for them to be deployed without problems. The prior an therefore shows no examples of fins which are both inclined and overlapping. The tilting of the fins therefore has a limiting effect on the total fin area.

It is therefore desirable to provide a maximization of the total fin area, at the same time as possibilities for other design measures, such as tilting of the fins, are retained.

According to an aspect of the invention, the tail portion indicated in the introduction is characterized in that the fins are arranged in at least two sections, which are arranged adjacent to one another in the axial direction.

BRIEF DESCRIPTION OF THE DRAWINGS

The invention will now be described with reference to appended drawings, in which.

DETAILED DESCRIPTION

Figure 1:
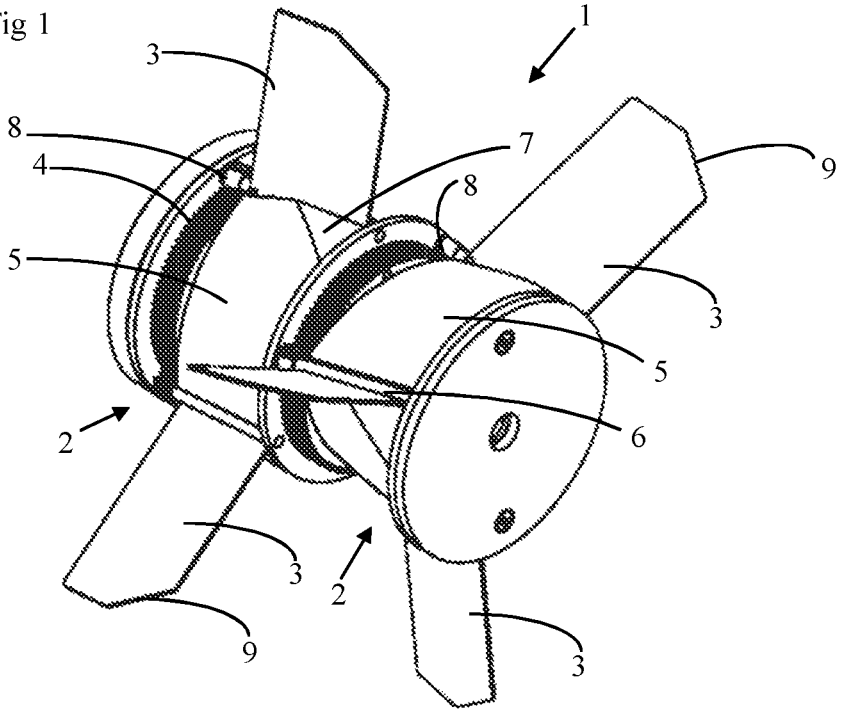
FIG. 1 shows a perspective view of an embodiment of a tail portion according to the invention.

In FIG. 1 is shown a tail portion 1 according to the invention for a projectile, such as a shell or the like. The projectile in its entirety is not shown, but only the tail portion which is the subject of the invention. The other parts of the projectile can be configured according to any design which is known to the person skilled in the art.

In the preferred embodiment, the tail portion 1 is divided into two sections 2, which are arranged adjacent to one another in the longitudinal direction of the tail portion 1 and of the projectile. In other words, the sections 2 are arranged one after the other, viewed in the notional direction of movement of the projectile.

Each section 2 has in the preferred embodiment three fins 3, but other embodiments, having different numbers of fins 3, are obviously accommodated within the scope of the inventive concept. The fins 3 have a deployed position, which is shown in FIG. 1, but also a stowed position, in which they are clamped against bearing surfaces 5. The stowed position is appropriate during storage, transport and loading of the projectile, before it is fired. In the preferred embodiment, the fins 3 are held in place in the stowed position with the aid of an overlying, cylindrical sleeve, or hood, (not shown), which is put in place during the production of the projectile. In conjunction with the firing, the sleeve is removed and the fins 3 assume their deployed position.

Each section 2 also has a linking member in the form of a manoeuvring ring 4, which functionally links together the fins 3 in the section 2. The linking members 4 of the different sections 2 are independent of one another.

The appearance and exact design of the fins 3 are variable within the scope of what the person skilled in the art is familiar with and deems appropriate. In addition to the size of the fin area, the maximum extent of the fins 3 from the centre of the projectile is of importance for the characteristics of the projectile. In the embodiment shown in FIG. 1, the fins 3 are inclined at an angle in relation to the longitudinal direction of the projectile. Each fin 3 extends in the stowed position as far as possible along a bearing surface 5, up to the next fin 3 in the circumferential direction, without overlapping this. The bearing surfaces 5 have an area which corresponds to the area of the respective fin 3. The size of the fins 3 is limited by the size of the bearing surfaces 5, and, for a maximization of the fin area 3, the fin area corresponds to the area of the whole of the bearing surface 5. The front edges of the fins 3, in the notional direction of movement, are in one embodiment bevelled in order to reduce the air resistance of the projectile.

Each bearing surface 5 should therefore be as large as possible. In order to make room for as large a bearing surface 5 as possible within a notional, cylindrical outer surface, which is defined by the maximum radius of the projectile and which is corresponded to by the overlying cylindrical sleeve prior to the firing of the projectile, each bearing surface 5 is convex and extends inside the space within the notional, cylindrical outer surface. The area of the bearing surface 5 is then greater than if the bearing surface were arranged along the notional, cylindrical, encompassing surface. Since two or more sections 2 are arranged one after the other on the fail portion 1, the total fin area is greater than if only one section 2 with fins 3 were arranged on the tail portion 1. As a result of the arrangement of two or more sections 2 one after the other, instead of a single section, it is also optionally achieved that the maximum extent of the fins 3 from the centre of the projectile increases, whilst the total fin area is kept constant, which gives the person skilled in tire art further chance to work on the characteristics of the projectile.

The curvature of the bearing surface 5 is such that each shaft 6, about which each fin 3 is pivotable, is arranged in or substantially parallel with the bearing surface 5. The shaft 6 slopes in relation to the longitudinal direction of the projectile, as can be seen especially well in FIG. 2, so that the desired tilting of the fins 3 is achieved. At the same time, the shaft 6, in the preferred embodiment, is, however, substantially parallel with the notional, cylindrical outer surface. The curvature of the bearing surface 5 will be described in further detail with reference to FIG. 5*a-c*.

The curvature of the bearing surface 5 is also such that it gradually nears the notional, cylindrical, encompassing surface, in the direction away from the shaft 6. At the far end of the bearing surface 5, viewed from the associated rotation shaft 6, the bearing surface 5 reaches up to the notional encompassing surface and merges there into a cylindrical portion 7. In order to avoid an overly severe bending of the fin 3 when it is clamped against the bearing surface 5, it has in the preferred embodiment a truncated corner portion 9 in the corresponding region. Even though it is desirable that the fin 3, in the deployed state, has as large an extent as possible, the truncated corner portion 9, in the shown embodiment, is a compromise between a large fin area and the possibility of keeping die fin 3 clamped against the projectile body during the firing.

The fins 3 are produced of an elastic material, so that they quickly resume their original, deployed shape when the overlying sleeve is removed upon the firing of the projectile.

The manoeuvring ring 4, as has been stated above, links the fins 3 in one and the same section 2. When the encompassing sleeve is pulled off from a section, upon the firing of the projectile at least one of the fins 3 will be deployed due to the elasticity in the material. This leads to a rotation of the fin 3 about the shaft 6, and the manoeuvring ring 4 will be rotated a short way, since each shaft 6, in the preferred embodiment, is provided with a small gearwheel 8 on its end. The gearwheel 8 engages with the manoeuvring ring 4, which is geared, and the rotary motion of the shaft 6 is in this way transmitted to the manoeuvring ring 4. The manoeuvring ring 4 in turn transmits its rotary motion to the other shafts 6, the fins 3 of which have probably also started a deployment. As a result of the interlinking, the deployment will take place synchronously, wherein a fin 3, which has a somewhat greater deployment tendency speeds up the other fins 3, and a fin 3 with somewhat later deployment slows the process a little. The synchronization of the deployment also means that the stabilization of the projectile is controlled and predictable.

Since the outer sleeve is typically pulled off in the axial direction, it can be expected that one section 2 is exposed at a time. Deployment of the fins 3 will rake place in the order in which the sections 2 are exposed. The sections 2 and their manoeuvring rings 4 are not interlinked, so the just described synchronization of the fin deployment will take place section by section in a controlled manner.

Figure 2:
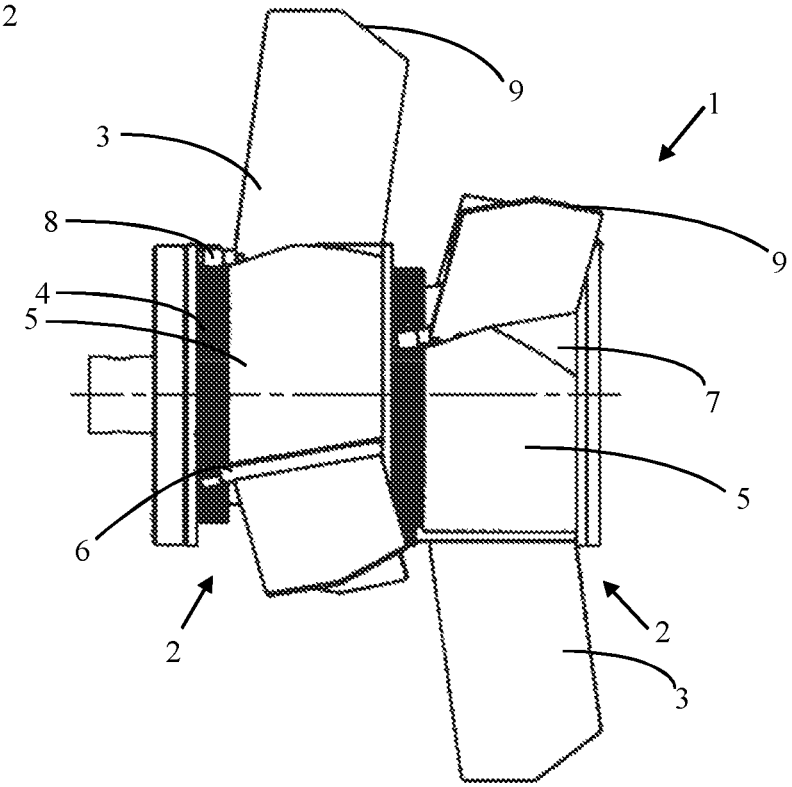
FIG. 2 shows a direct side view of the tail portion according to FIG. 1.
Figure 3:
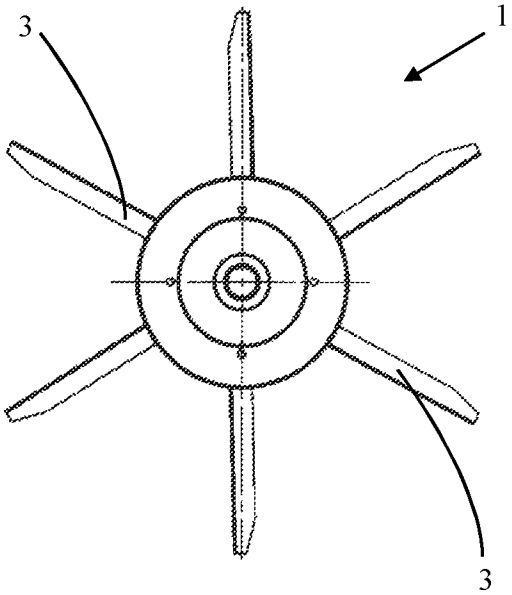
FIG. 3 shows an end view of the tail portion according to FIG. 1.

In FIG. 3, the tail portion 1 is shown from its rear end. In this figure, it can clearly be seen that the fins 3, which are also shown in FIGS. 1 and 2, are evenly distributed over the circumference of the tail portion 1 in the preferred embodiment. This is a result of that placement of the fin shafts 6 which has been chosen in the preferred embodiment. A person skilled in the art in this field can after routine tests choose other placements of the fin shafts 6 if it provides other desired characteristics of the projectile when this is in a trajectory on the way towards a target.

Figure 4A:
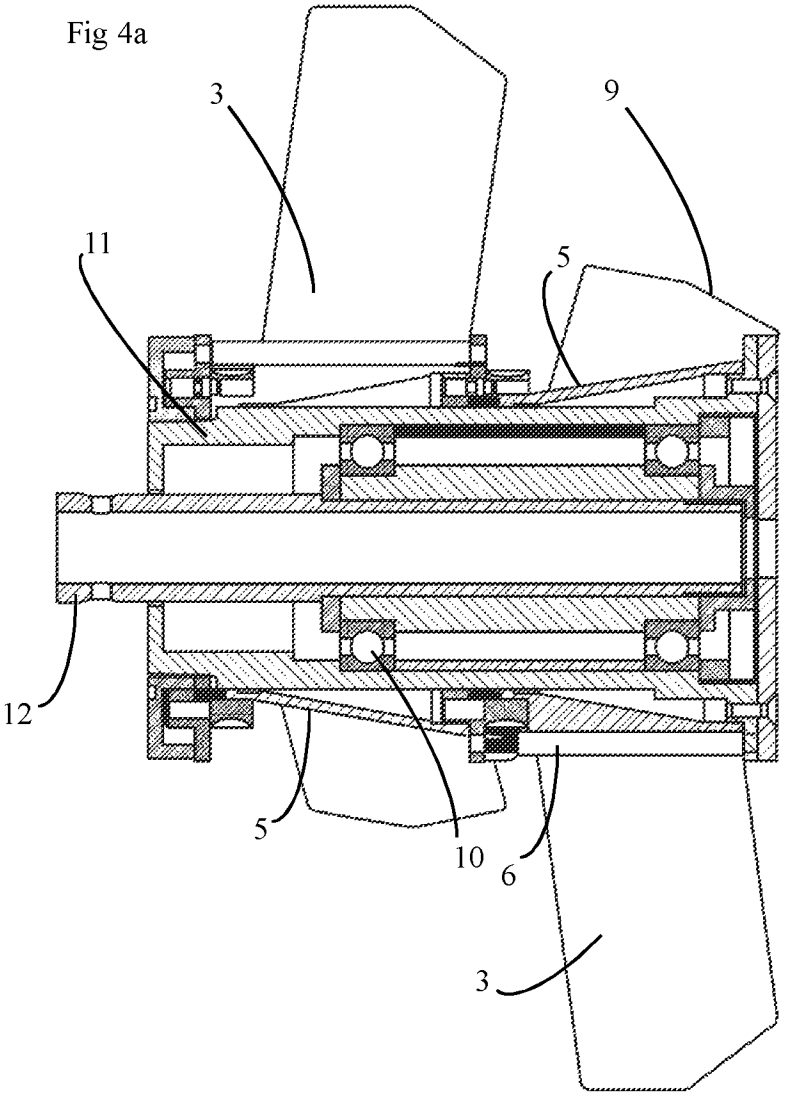
FIG. 4*a* shows a sectional view of the tail portion according to FIG. 1.
Figure 4B:
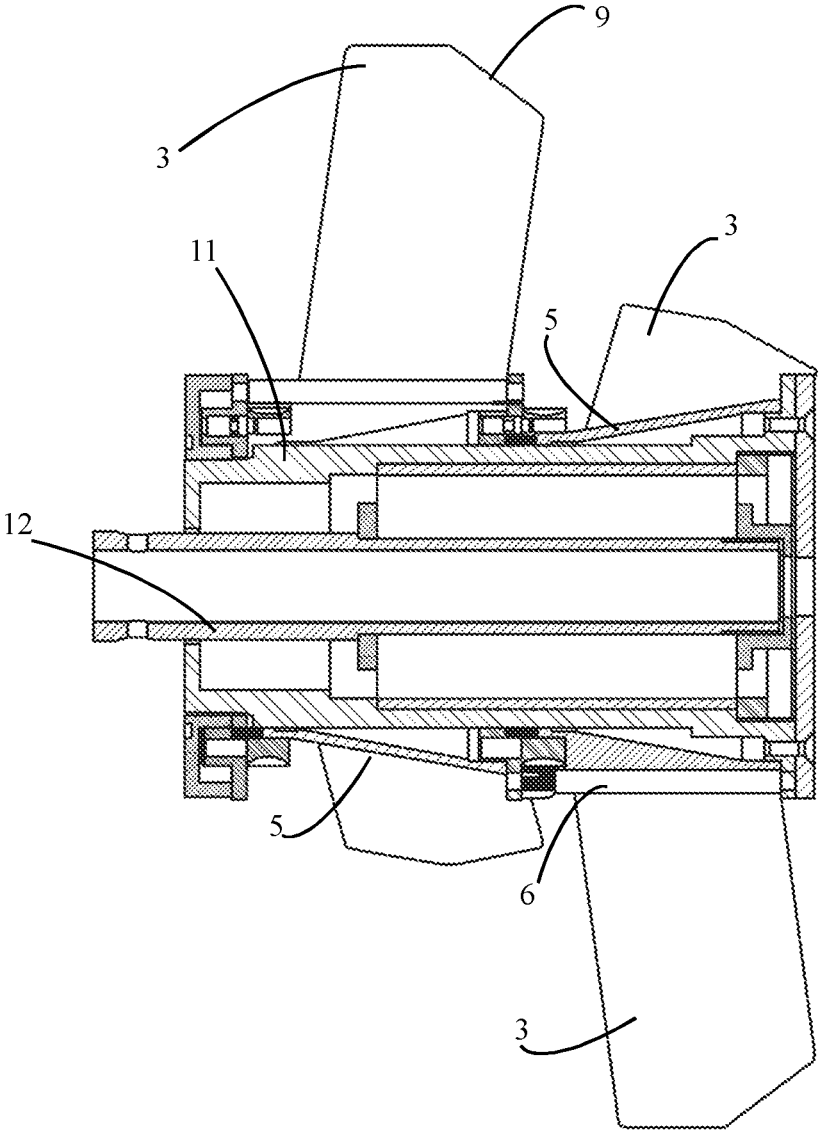
FIG. 4*b* shows a sectional view of another embodiment of the tail portion.

FIGS. 4*a* and 4*b* show in a sectional view two different variants of the tail portion 1. The variant in FIG. 4*a* is a free-spinning tail portion 1, in which an outer pan 11 of the tail portion 1 is rotatably arranged on an inner shaft 12, and is hence arranged rotatably in relation to the rest of the projectile. The rotatability of the outer part 11 in relation to the inner shaft 12 is preferably achieved with the aid of ball bearings 10, even though other means which are known to the person skilled in the an are conceivable. In FIG. 4*b* is shown a fixed tail portion. To use both fixed and free-spinning tail portions 1 is per se previously known to the person skilled in the art. The tail portion 1 according to the invention has substantially the same configuration in other parts, regardless of whether it is arranged in a fixed or free-spinning manner.

Figure 5A:
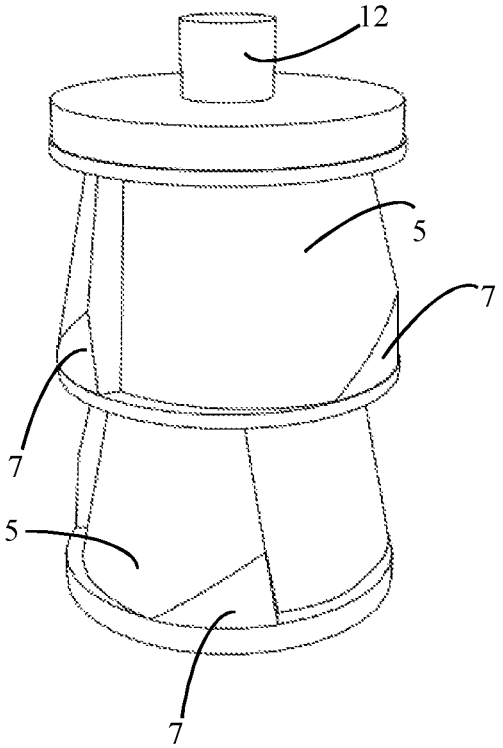
FIG. 5*a* shows a schematic perspective view of a tail portion according to the invention, in which, inter alia, the fins have been omitted.
Figure 5B:
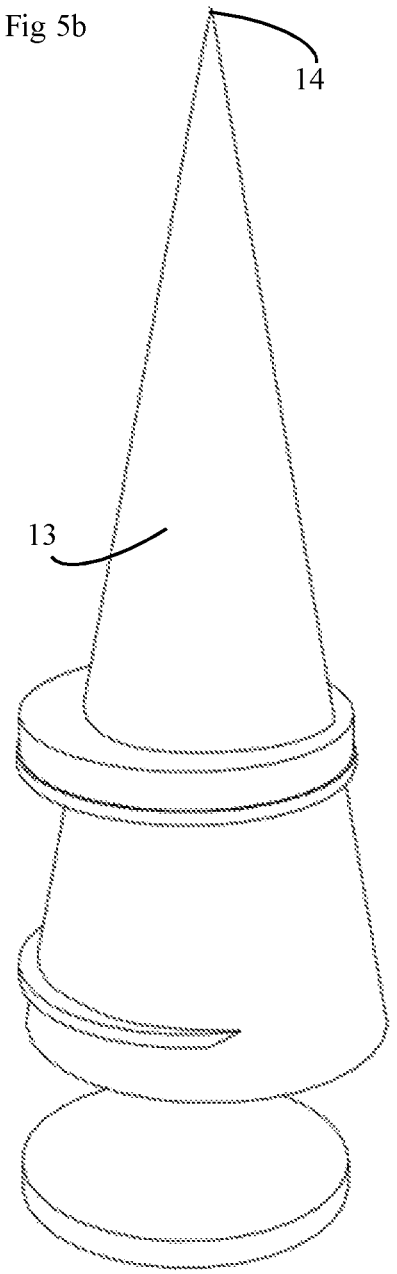
FIG. 5*b* shows a first basic diagram, which illustrates the configuration of bearing surfaces forming part of the tail portion according to the invention.
Figure 5C:
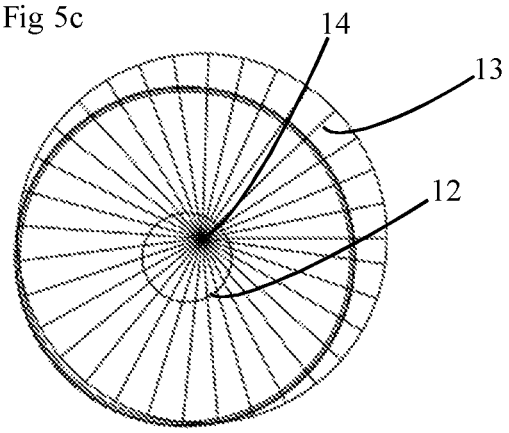
FIG. 5*c* shows a second basic diagram, which illustrates the configuration of the bearing surfaces.

FIGS. 5*a*-5*c* illustrate how the bearing surfaces 5 are configured. In FIG. 5*a*, the tail portion 1 is shown in a simplified form, in which both the fins 3, their shafts 6, and the manoeuvring rings 4 on the two sections 2 have been removed in order that the bearing surfaces 5 shall be seen as clearly as possible. On the left in FIG. 5*a* can be seen that both the upper and the lower bearing surfaces 5 are located at a distance from the cylindrical outer contour. In the direction to the right in FIG. 5*a*, the distance between the respective bearing surface 5 and the outer contour gradually diminishes. Where the bearing surface 5 reaches the outer contour, it merges into the cylindrical surface portion 7. At the same time, each bearing surface 5 slopes inwards, away from the cylindrical outer contour, so that its area is as large as possible. Each bearing surface 5 coincides with a part of an envelope surface of a notional cone.

The notional cone 13 is, however, different for the different bearing surfaces 5. In FIG. 5*b* is show n such a cone 13, which can illustrate how each bearing surface 5 has been given its shape. The apex 14 of the notional cone 13 is displaced in the lateral direction in relation to the centre of the tail portion 1. Tins has the result that tire envelope surface of the cone 13 is arranged asymmetrically both in relation to the centre of tire tail portion 1 and in relation to the cylindrical outer contour. The centre line of the cone 13 can be parallel with the centre line of the projectile, but in many embodiments forms an angle thereto. Through these measures relating to the calculation of the notional cone 13, also the bearing surface 5 which coincides with a pan of the envelope surface is arranged asymmetrically in relation to the cylindrical outer contour.

Each bearing surface 5 coincides with an own notional cone 13, both the bearing surfaces 5 which lie in the same section 2 and the bearing surfaces 5 which are located in different sections 2. Thus, in the shown embodiment, six different cones 13 have been calculated in support of the configuration of the six different bearing surfaces 5. FIGS. 5*b* and 5*c*, for the sake of clarity, only one of these cones 13 is shown. With the aid of computer-aided production technology, the tail portion 1 according to FIG. 5*a* will be able to be produced.

FIG. 5*c*, the notional cone 13 is shown directly from above, and the displacement of the apex 14 in relation to the centre of the tail portion 1 can be clearly seen.

The proposed solution has a number of advantages in relation to existing technology comprising fins arranged in only one section. In the first place, technical solutions in which a very small space is available to achieve a sufficient total fin area are enabled. Moreover, the maximum extent of the fins 3 from the centre of the projectile, the span, is increased, at the same time as the total fin area is maintained. The time it takes to spin up the projectile to the correct rotation speed is reduced, moreover, by at least 50% in relation to solutions comprising a single fin section, and the stability margin increases.

The embodiments which have been shown in the figures have two sections 2 arranged adjacent to one another in the longitudinal direction of the projectile, but, as has already been stated above, embodiments in which more than two sections 2 comprising fins 3 are arranged adjacent to one another are also covered by the invention.

The size and shape of the fins 3 are affected by the configuration of the bearing surfaces 5, which in turn is determined by the size of the notional cone 13 and its displacement and angle in relation to the centre line of the tail portion 1. A number of different appearances of the bearing surfaces 5 are therefore possible to achieve within the scope of these principles, even though not all variants are shown in the figures. The shape and size of the fins 3 are variable in dependence on the projectile characteristics which are sought, but are naturally limited by the shape and size of the bearing surfaces 5.

The placement of the fin shafts 6 in the circumferential direction of the tail portion is also variable in many different ways. In the drawings, a placement in which the fin shafts 6 are evenly scattered over the circumference of the tail portion 1 has been shown. As has already been indicated in the description above with reference to FIG. 3, many other variants are conceivable, depending on which characteristics are desired in the projectile. An example of fin placement is that the fins 3 and the fin shafts 6 are placed symmetrically in the circumferential direction within their section 2, but that the fins 3 in the different sections are displaced only a short way, so that groups comprising fins 3 from different sections 2 are produced. With two rows of three fins, the separation angle is 120° between the three fins in each section or segment. The two rows must be asymmetrically displaced in relation to one another so that the separation angle is not 60° between two fins, but rather 70° and 50°, for example, for the respective pair. In this way, a very good result has been attained for certain applications.

Another way of achieving a grouping of the fins 3 is to make the fins 3 form the groups section by section.

A further variation option for achieving other embodiments is that certain sections 2 are provided with a greater number of fins 3, whilst other sections 2 have fewer. The size of the fins 3 is also mutually variable, for example by virtue of the fact that the fins 3 in one section 2 are consistently larger than in another section 2.

The cylindrical sleeve, which covers the fins 3 when they are clamped against tire bearing surfaces 5, can be a separate component in certain embodiments, but can also be produced as a pan of the cartridge case. The cartridge case covers a greater or lesser part of the projectile and contains the propellant charge and the ignition agent. The cartridge case will be separated from the projectile during a certain stage of the firing, and the fins 3 will in principle at the same time be laid bare and can be deployed as soon as the projectile has left the barrel.

The various embodiments which have just been described can be freely combined with one another to form further embodiments, within the scope of the calculations and tests of the person skilled in the art, in order to achieve the desired characteristics of the projectile.

The invention is further variable within the scope of the appended patent claims.

The invention claimed is:

1. A tail portion for a fin-stabilized projectile, comprising at least two deployable fins, which are inclined, wherein the fins are arranged in at least two sections, which are arranged adjacent to one another in the axial direction, the fins being made of an elastic material, wherein each fin, prior to deployment, bears against a convex bearing surface, which extends within a cylindrical, circumscribing surface which is defined by the radius of the projectile, and wherein each bearing surface coincides with a part of the envelope surface of a notional cone, the apex of which is displaced from the centre axis of the projectile.

2. The tail portion according to claim 1, wherein each section contains at least two fins.

3. The tail portion according to claim 2, wherein the fins which form part of one and the same section are synchronously deployable by means of a linking member, to which the fins forming part of the section are coupled.

4. The tail portion according to claim 3, wherein the linking members in the different sections are independent of one another.

5. The tail portion according to claim 1, wherein each fin, prior to deployment, bears against a convex bearing surface, which extends within a cylindrical, circumscribing surface which is defined by the radius of the projectile.

6. A tail portion for a fin-stabilized projectile, comprising at least two deployable fins, which are inclined, wherein the fins are arranged in at least two sections, which are arranged adjacent to one another in the axial direction, wherein each fin, prior to deployment, bears against a convex bearing surface, which extends within a cylindrical, circumscribing surface which is defined by the radius of the projectile, and wherein each bearing surface coincides with a part of the envelope surface of a notional cone, the apex of which is displaced from the centre axis of the projectile.

7. The tail portion according to claim 6, wherein the different bearing surfaces coincide with the envelope surfaces of different notional cones, the apices of which are displaced in relation to one another.

8. The tail portion according to claim 5, wherein a cylindrical sleeve is arranged over the fins prior to deployment in order to hold them in place against the bearing surfaces.

9. The tail portion according to claim 8, wherein the cylindrical sleeve can be axially pulled off from the fin sections.

10. The tail portion according to claim 8, wherein the cylindrical sleeve is a part of a cartridge case which encloses at least a part of the projectile.

11. The tail portion according to claim 1, wherein fins forming part of at least two sections are arranged in groups around the circumference of the projectile.

12. The tail portion according to claim 1, wherein the fins which form part of the different sections are evenly distributed over the circumference of the projectile.

13. The tail portion according to claim 1, wherein the front edges of the fins are bevelled.

* * * * *